US012130120B2

(12) United States Patent
Langdon

(10) Patent No.: US 12,130,120 B2
(45) Date of Patent: Oct. 29, 2024

(54) METHODS AND APPARATUS FOR OPTICAL ADAPTER FOR FIREARM SLIDE

(71) Applicant: Langdon Tactical Technology Inc., Gilbert, AZ (US)

(72) Inventor: Ernest Langdon, Gilbert, AZ (US)

(73) Assignee: Langdon Technical Technology Inc., Gilbert, AZ (US)

( * ) Notice: Subject to any disclaimer, the term of this patent is extended or adjusted under 35 U.S.C. 154(b) by 0 days.

(21) Appl. No.: 18/305,659

(22) Filed: Apr. 24, 2023

(65) Prior Publication Data

US 2023/0280135 A1 Sep. 7, 2023

Related U.S. Application Data

(63) Continuation of application No. 17/169,695, filed on Feb. 8, 2021, now Pat. No. 11,644,280.

(60) Provisional application No. 62/977,903, filed on Feb. 18, 2020.

(51) Int. Cl.

| | |
|---|---|
| ***F41G 11/00*** | (2006.01) |
| ***F41A 17/72*** | (2006.01) |
| ***F41G 1/16*** | (2006.01) |

(52) U.S. Cl.

CPC ..... *F41G 11/001* (2013.01); *F41A 17/72* (2013.01); *F41G 1/16* (2013.01)

(58) Field of Classification Search

CPC ..... F41G 1/30; F41G 11/001; F41G 11/003; F41G 1/16

See application file for complete search history.

(56) References Cited

U.S. PATENT DOCUMENTS

| | | | | |
|---|---|---|---|---|
| 6,327,806 | B1 | 12/2001 | Paige | |
| 9,506,726 | B2 * | 11/2016 | Wolf | F41G 1/26 |
| 10,024,628 | B2 * | 7/2018 | Toner | F41G 1/16 |
| 10,563,955 | B2 * | 2/2020 | Pniel | F41G 1/16 |
| 10,871,350 | B1 * | 12/2020 | Thomas | F41G 1/16 |
| 10,876,815 | B1 * | 12/2020 | Wingfield | F41G 1/16 |
| 11,067,348 | B1 * | 7/2021 | Ribic | F41A 3/66 |
| 2014/0230305 | A1 * | 8/2014 | Zimmer | F41C 3/00 42/111 |
| 2015/0268002 | A1 * | 9/2015 | Jeung | F41G 1/30 42/71.02 |
| 2017/0059277 | A1 * | 3/2017 | Justice | F41G 11/003 |
| 2018/0195835 | A1 * | 7/2018 | Crispin | F41G 1/30 |
| 2019/0049217 | A1 * | 2/2019 | Costet | F41G 1/16 |
| 2019/0257620 | A1 * | 8/2019 | Zimmer | F41C 3/00 |
| 2019/0331461 | A1 * | 10/2019 | Zimmer | F41G 1/17 |
| 2020/0025520 | A1 * | 1/2020 | Niswander | F41G 11/003 |
| 2021/0222978 | A1 * | 7/2021 | Bachstein | F41A 15/12 |
| 2021/0231407 | A1 * | 7/2021 | Salinas | F41G 11/00 |

* cited by examiner

*Primary Examiner* — Joshua E Freeman

(57) ABSTRACT

An apparatus and method for modifying a handgun to accept an optical sight comprises a modified slide mechanism adapted to include a flat recessed rear section configured to receive an adapter plate for mounting an optical sight. Various embodiments of the adapter include modified internal components used to replace stock components what will no longer fit within the modified profile of the slide mechanism. Replacement of the slide mechanism and associated internal components will allow a user to add an optical sight to an existing handgun.

15 Claims, 8 Drawing Sheets

METHODS AND APPARATUS FOR OPTICAL ADAPTER FOR FIREARM SLIDE

CROSS-REFERENCES TO RELATED APPLICATIONS

This application is a continuation of U.S. patent application Ser. No. 17/169,695 filed on Feb. 8, 2021, which claims the benefit of U.S. Provisional Patent Application No. 62/977,903, filed Feb. 18, 2020, and incorporates the disclosure of each by reference. To the extent that the present disclosure conflicts with any referenced application, however, the present disclosure is to be given priority.

BACKGROUND OF THE TECHNOLOGY

Gun sights are used to help improve accuracy and there are many different types of sights available to choose from. A common type of gun sight that typically comes standard on handguns is an iron sight which consists of a forward component and a rear component that in combination help a user direct the projectile towards a target. While very common, iron sights, may not always be the preferred type of sight for a given firearm. For example, a telescopic sight may be more useful for long range targets when using a rifle. Laser sights and reflex based optical sights may be used in place of an iron sight on a handgun to provide the user with a more highly visible sight.

It is not always possible to simply replace an iron sight with a different type of sight. For example, certain types of optical sights are manufactured with a standard profile that can be connected to the top of a firearm. This standard profile, however, may not fit every type of firearm. For example, some handguns manufactured prior to the broad use of optical sights may have a profile that cannot be easily adapted to mount an optical sight due to the narrowness or roundness of an uppermost surface of the slide mechanism of the firearm. Adapters for the slide mechanism have attempted to allow optical sights to be used with these types of firearms but suffer from various drawbacks such as not being sufficiently strong enough to endure the recoil forces on the slide mechanism when the firearm is fired.

SUMMARY OF THE TECHNOLOGY

An apparatus and method for modifying a handgun to accept an optical sight comprises a modified slide mechanism adapted to include a flat recessed rear section configured to receive an adapter plate for mounting an optical sight. Various embodiments of the adapter include modified internal components used to replace stock components what will no longer fit within the modified profile of the slide mechanism. Replacement of the slide mechanism and associated internal components will allow a user to add an optical sight to an existing handgun.

BRIEF DESCRIPTION OF THE DRAWINGS

A more complete understanding of the present technology may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present technology.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various materials, finishes, dimensions, and geometries, which may carry out a variety of operations suited to a specified application or environment. In addition, the present technology may be practiced in conjunction with any number of systems configured for operation with firearms, and the system described is merely one exemplary application for the technology. Further, the present technology may employ any number of conventional techniques for machining, metalworking, and gunsmithing.

Methods and apparatus for an optical adapter for a firearm slide according to various aspects of the present technology may operate in conjunction with any type of handgun or various slide mechanisms used in firearms. Various representative implementations of the present technology may be applied to retrofitting an existing semi-automatic handgun, modifying a new firearm, or manufacturing a new firearm. For example, the described technology may be used to replace or modify an original factory installed slide mechanism and one or more internal components of a Beretta® model 92 pistol, and other like models such as: the Taurus® PT92, Girsan® Regard MC, Helwan 920, Vektor Z88, SP1, and SP2, Yavuz 16, and the AT92, to provide a suitable surface for mounting an optical sight on the pistol when the slide mechanism as originally manufactured is not suitable for receiving a mounted optical sight.

Figure 1:
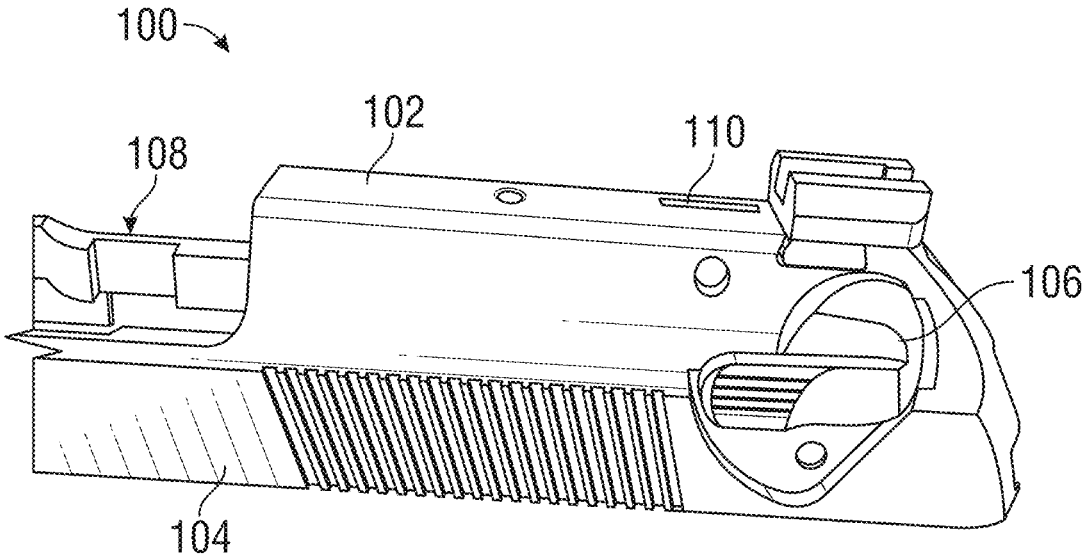
FIG. 1 (Prior Art)
FIG. 1 representatively illustrates an unmodified prior art slide in accordance with an exemplary embodiment of the present technology.

For example, and referring to FIG. 1, a prior art unmodified slide mechanism 100 may comprise an upper surface 102, a lower portion 104, a selector switch or safety lever 106, and an open barrel portion 108. The upper surface 102 may be unsuitable for mounting an optical sight because the upper surface 102 is either too narrow or too round to provide an adequate surface capable of receiving an optical sight and holding it in position during use. Further, a top surface of firing pin block 110 may sit generally flush with the upper surface 102 prior to and after firing but may moves upwards and extend above the upper surface 102 by small amount, such as by about 0.5-2.0 millimeters, when the trigger is pulled.

Figure 2:
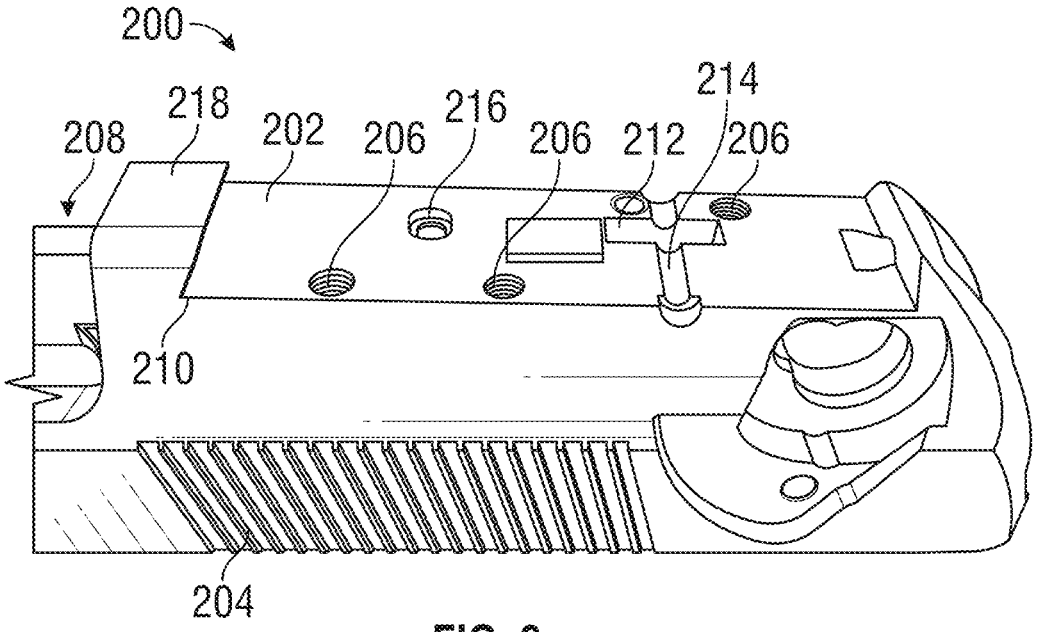
FIG. 2 representatively illustrates a modified slide for receiving an optical sight in accordance with an exemplary embodiment of the present technology.
Figure 4:
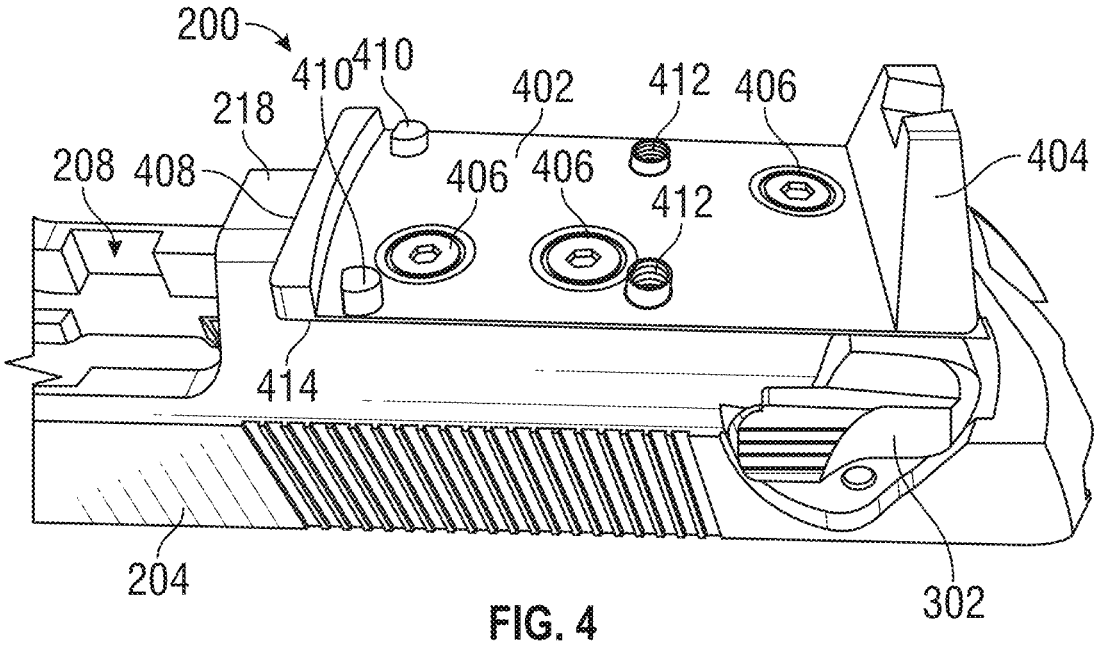
FIG. 4 representatively illustrates an adapter plate connected to the modified slide in accordance with an exemplary embodiment of the present technology.
Figure 5:
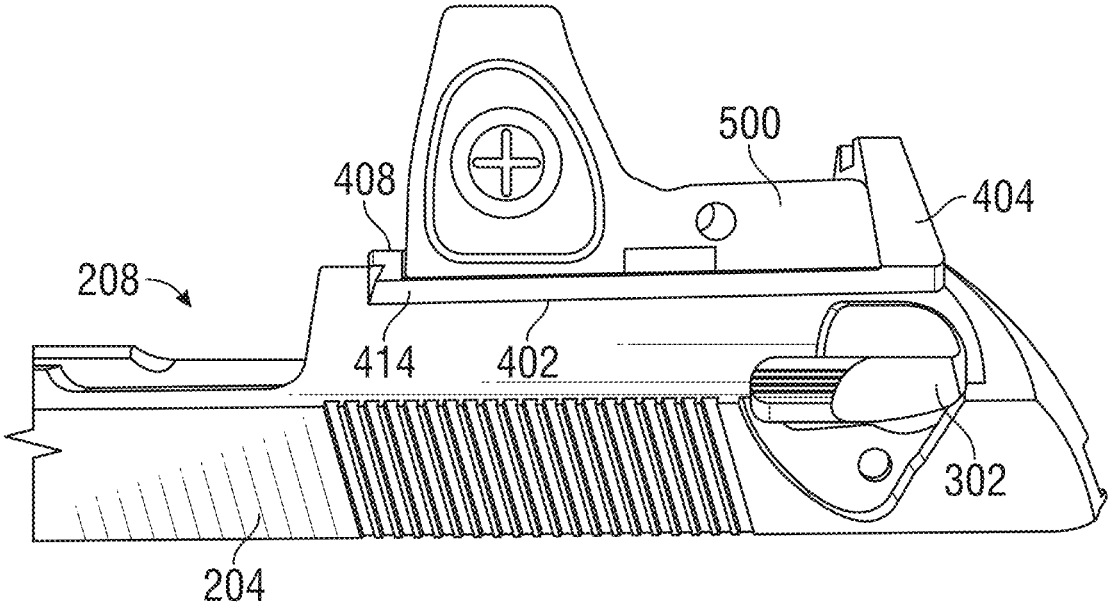
FIG. 5 representatively illustrates a side view of an optical sight connected to the adapter plate and the modified slide in accordance with an exemplary embodiment of the present technology.
Figure 6:
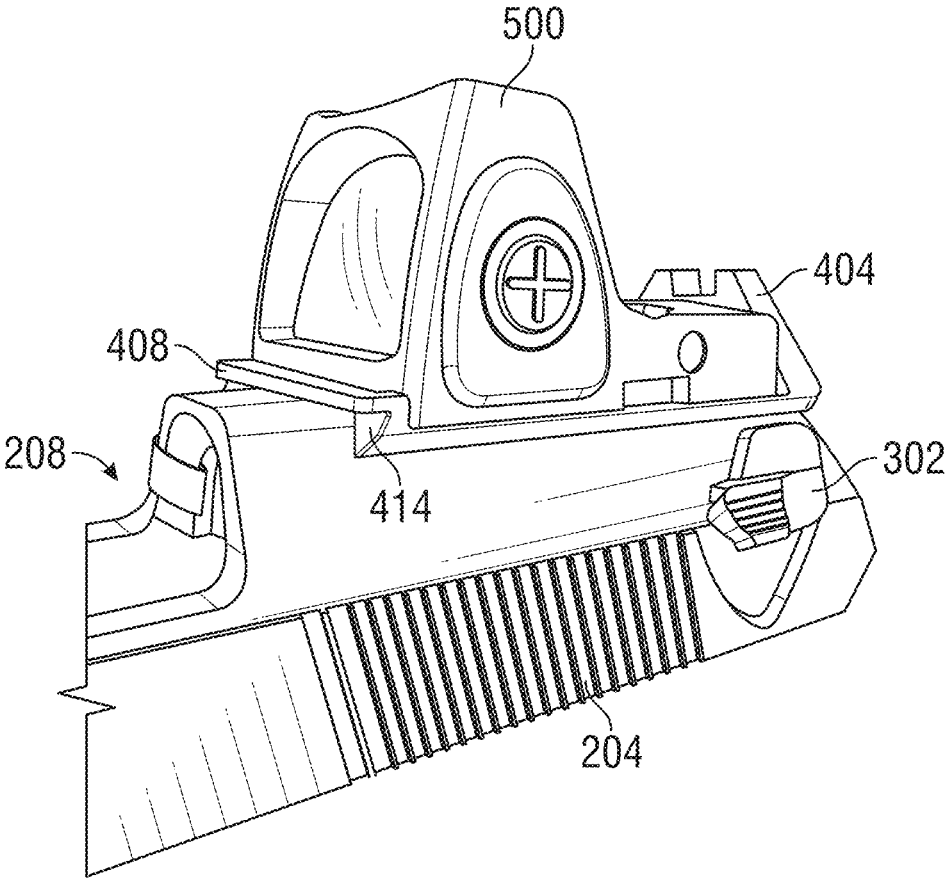
FIG. 6 representatively illustrates a front perspective view of the optical sight connected to the adapter plate shown in FIG. 5 in accordance with an exemplary embodiment of the present technology.
Figure 8:
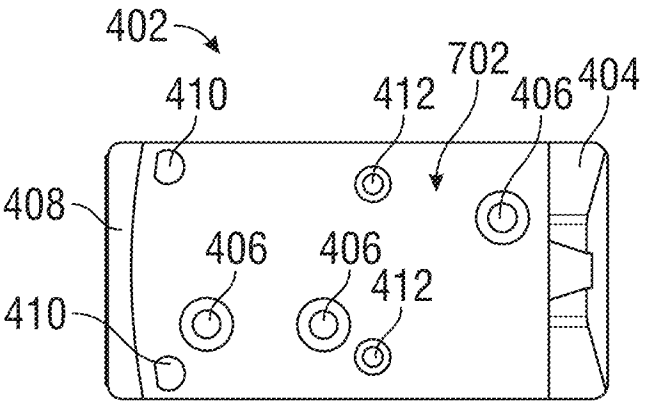
FIG. 8 representatively illustrates a top view of the adapter plate in accordance with an exemplary embodiment of the present technology.
Figure 10:
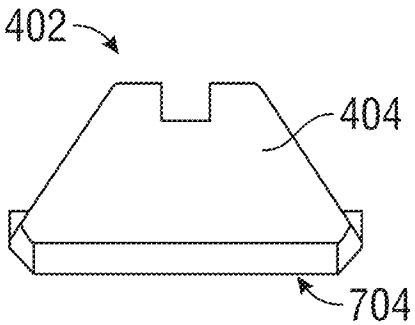
FIG. 10 representatively illustrates an end view of adapter plate in accordance with an exemplary embodiment of the present technology.
Figure 7:
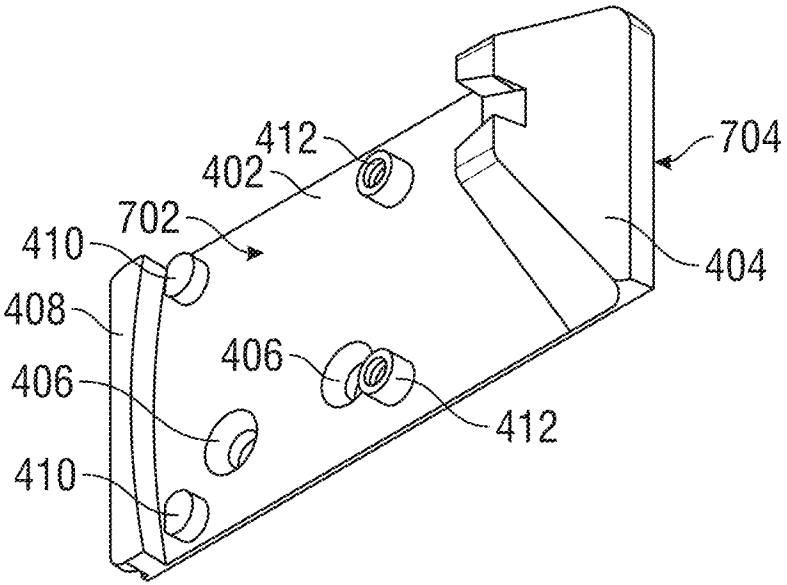
FIG. 7 representatively illustrates a perspective view of an adapter plate in accordance with an exemplary embodiment of the present technology.
Figure 9:
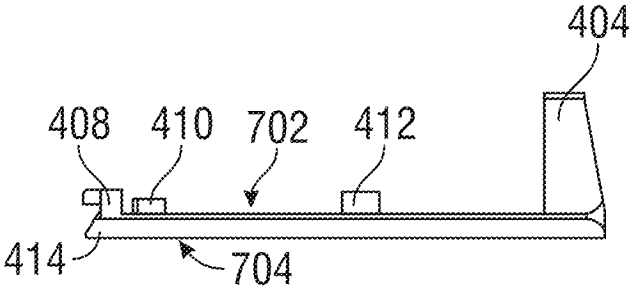
FIG. 9 representatively illustrates a side view of the adapter plate in accordance with an exemplary embodiment of the present technology.

Referring now to FIGS. 2 and 4, a modified slide mechanism 200 may comprise a body having a flat upper surface 202 that is recessed below a top most surface 218 of the body located aft of an open barrel portion 208, and a lower portion 204. A first set of mounting holes 206 may be created in the flat upper surface 202 and used to connect to an adapter plate 402. A forward end 210 of the flat upper surface 202 may be angled, beveled, notched, or otherwise configured to create a more secure connection between the modified slide mechanism 200 and the adapter plate 402.

The recessed the flat upper surface 202 may be formed by modifying an existing stock slide mechanism. For example, an upper surface of a factory manufactured stock slide mechanism may be machined to form the recessed the flat upper surface 202. This modified slide mechanism may then be used in place of the original stock slide mechanism. Alternatively, the flat upper surface 202 may be formed as part of a replacement slide mechanism that was manufactured as a direct replacement for a stock slide mechanism.

Figure 30:
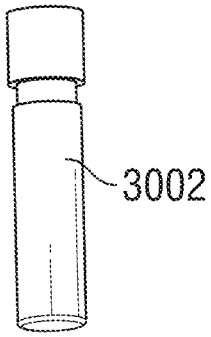
FIG. 30 (Prior Art)
FIG. 30 representatively illustrates a prior art extractor pin in accordance with an exemplary embodiment of the present technology.
Figure 31:
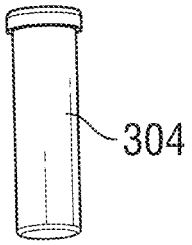
FIG. 31 representatively illustrates a modified extractor pin in accordance with an exemplary embodiment of the present technology.

Whether by modifying a stock slide mechanism or replacing a stock slide mechanism with a replacement, the flat upper surface 202 may expose interior components of the slide mechanism or render existing stock internal components nonfunctional. For example, if the prior art unmodified slide mechanism 100 is modified according to the present technology, the recessed flat upper surface 202 may extend downwards into the upper surface of the unmodified slide mechanism 100 such that a first opening 212 for a standard firing pin block 110 (See FIG. 11), a recess 214 for a standard retention pin for the firing pin block 110, and a second opening 216 for a standard extractor pin 3002 (See FIG. 30) may be exposed. One of ordinary skill in the art will appreciate that the first and second openings 212, 216 and recess 214 indicate areas within the unmodified slide mechanism 100 where the standard firing pin block 110, extractor pin 3002, and retention pin were located prior to the removal of a portion of the upper surface 102. With the portion of the upper surface 102 removed, the standard firing pin block 110, extractor pin 3002, and retention pin no longer function as intended and must be replaced with modified components configured to fit within the smaller profile of the modified slide mechanism 200.

Figure 3:
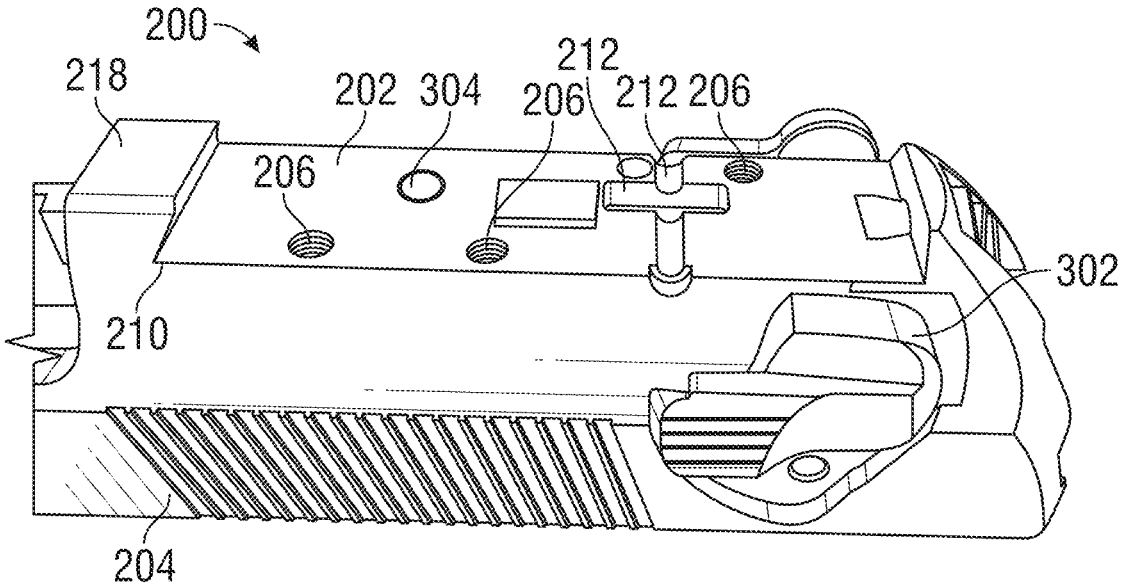
FIG. 3 representatively illustrates a partially assembled modified slide with a modified safety lever and modified plunger in accordance with an exemplary embodiment of the present technology.
Figure 26:
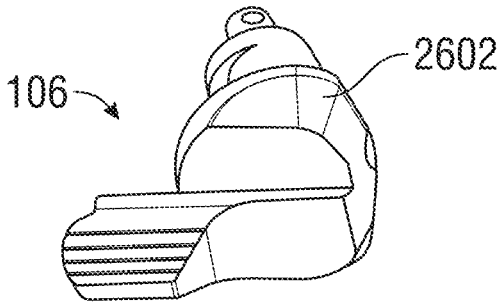
FIG. 26 (Prior Art)
FIG. 26 representatively illustrates a prior art safety lever in accordance with an exemplary embodiment of the present technology.
Figure 27:
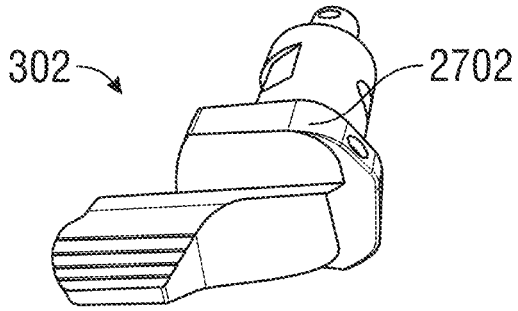
FIG. 27 representatively illustrates a modified safety lever in accordance with an exemplary embodiment of the present technology.
Figure 28:
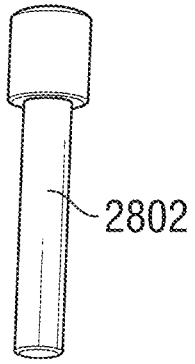
FIG. 28 (Prior Art)
FIG. 28 representatively illustrates a prior art plunger in accordance with an exemplary embodiment of the present technology.
Figure 29:
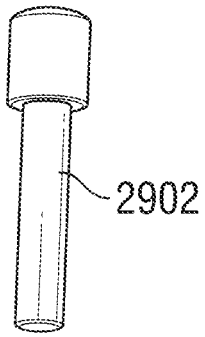
FIG. 29 representatively illustrates a modified plunger in accordance with an exemplary embodiment of the present technology.

Referring now to FIG. 3, when the modified slide mechanism 200 is assembled, a modified extractor pin 304 (See also FIG. 29) may be installed such that it does not extend above the flat upper surface 202. A modified selector switch or safety lever 302 may also be installed within modified slide mechanism 200, wherein the safety lever 302 may also be configured to function within the smaller profile by having a reduced radius on an upper surface that does not extend above the flat upper surface 202. For example, referring now to FIGS. 26 and 27, a prior art safety lever 106 may comprise an upper radius 2602 that is significantly larger than the upper radius 2702 of the modified safety lever 302. Similarly, with particular reference to FIGS. 28 and 29, a standard safety plunger 2802 may be replaced with a modified safety plunger 2902 that has a smaller length to accommodate the smaller radius of the modified safety lever 302.

Referring now to FIGS. 4-10, an adapter plate 402 may be connected to the flat upper surface 202 to provide a secure mounting location for an optics assembly 500 such as a reflex sight or red dot optic sight. The adapter plate 402 may comprise any suitable components configured to connect the adapter plate 402 to the flat upper surface 202 and the optics assembly 500.

The adapter plate 402 may comprise a substantially flat top surface 702 and an underside surface 704 that may at least partially conform to the top surface of the slide mechanism 200. Alternatively, the underside surface 704 may be flat and configured to mate up against the flat upper surface 202 of the modified slide mechanism 200. A second set of mounting holes 406 may be positioned on the adapter plate 402 to allow the adapter plate 402 to be coupled to the mating first set of mounting holes 206 on the flat upper surface 202 of the slide mechanism 200. Any suitable type of fastener such as a screw or bolt may be used to couple the adapter mounting holes 406, 206 together.

The adapter plate 402 may further comprise one or more mounting busses 410 disposed along the top surface 702 that are configured to couple to a pair of mating bosses in the optics assembly 500. A third set of mounting holes or receiving ports 412 may also be located on the top surface 702 and may be used to couple the adapter plate 402 to the optics assembly 500. A sighting element 404 may be positioned along a rearmost edge of the adapter plate 402. A forward section of the adapter plate 402 may comprise a lip 408 configured to be positioned along the top most surface 218 of the slide mechanism 200 when an angled forward edge 414 is positioned in the forward end 210 of the flat upper surface 202.

Figure 11:
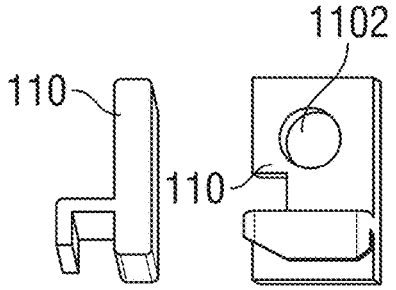
FIG. 11 (Prior Art)
FIG. 11 representatively illustrates a rear and side view of a prior art firing pin block in accordance with an exemplary embodiment of the present technology.
Figure 12:
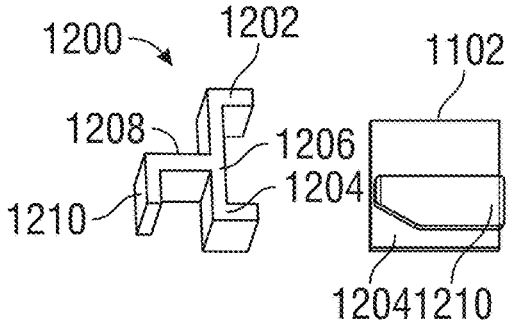
FIG. 12 representatively illustrates a rear and side view of a modified firing pin block in accordance with an exemplary embodiment of the present technology.
Figure 13:
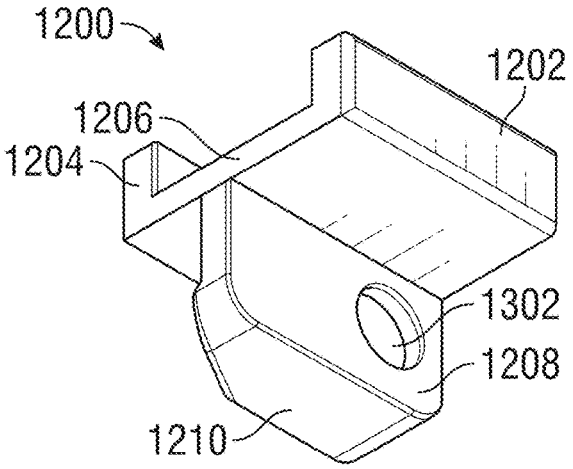
FIG. 13 representatively illustrates a perspective view of the modified firing pin block in accordance with an exemplary embodiment of the present technology.
Figure 14:
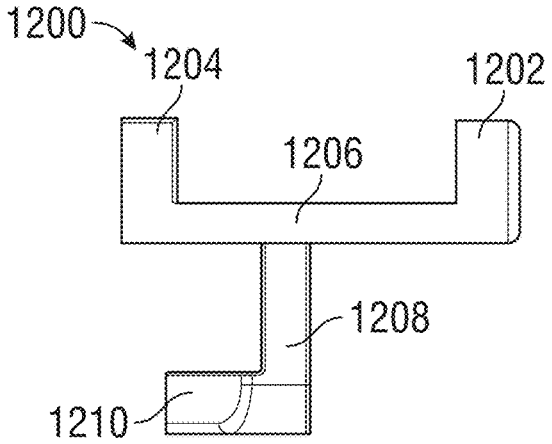
FIG. 14 representatively illustrates a rear view of the modified firing pin block in accordance with an exemplary embodiment of the present technology.
Figure 15:
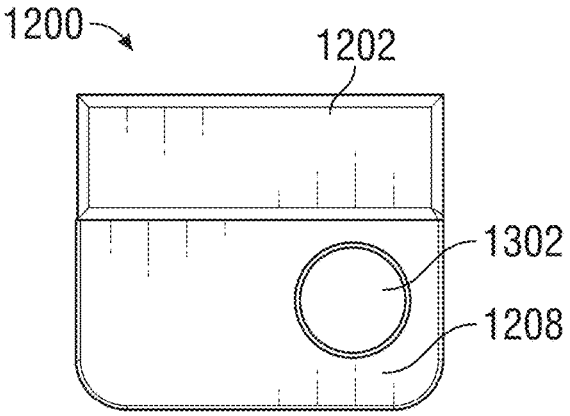
FIG. 15 representatively illustrates a top view of the modified firing pin block in accordance with an exemplary embodiment of the present technology.

Referring now to FIG. 11, as described above, an unmodified slide mechanism 100 may utilize a standard firing pin block 110 that has an opening 1102 for a retention pin. The top of the standard firing pin block 110, however, may extend above the top upper surface 102 when the trigger is pulled and prevent the adapter plate 402 from mating flush with the flat upper surface 202. Further, because there is no room for a retention pin the standard firing pin block 110 may no longer be able to be coupled to the firing pin causing the firearm to not function.

To solve this issue, and referring now to FIGS. 12-15, a modified firing pin block 1200 may be used in place of the standard firing pin block 110. The modified firing pin block 1200 may require a lower profile that does not extend above the flat upper surface 202 when the trigger is pulled. The modified firing pin block 1200 may not include an opening for a retention pin and may be configured to couple to the firing pin by another method.

In one embodiment, the modified firing pin block 1200 may comprise a body having a central body having a pair of opposing ends. Each of the opposing ends may comprise an edge section 1202, 1204 that extends perpendicularly away from the ends of the central body. A center catch 1208 may extend perpendicularly away from a center portion 1206 of the central body in a direction opposite that of the edge sections 1202, 1204. The center catch 1208 may comprise a lip 1210 and is angled perpendicular to the direction of the center catch 1208 and is parallel to the central body. A recessed detent 1302 may be disposed in a surface of the center catch 1208 that is opposite that of the lip 1210.

Figure 16:
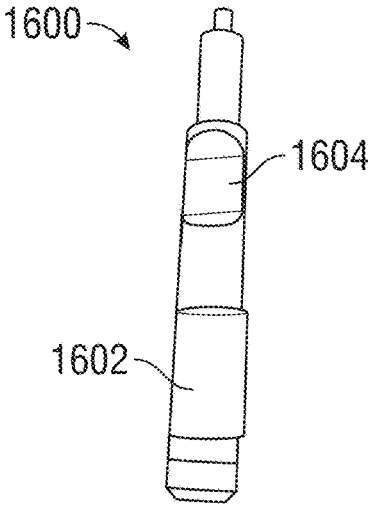
FIG. 16 (Prior Art)
FIG. 16 representatively illustrates a prior art firing pin in accordance with an exemplary embodiment of the present technology.
Figure 17:
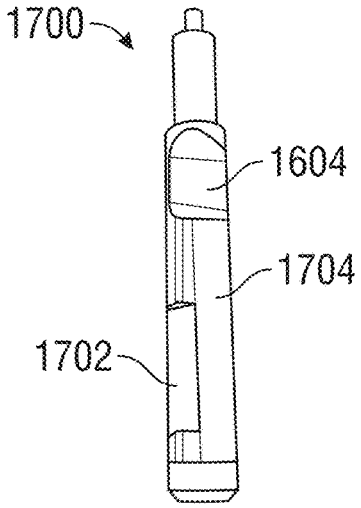
FIG. 17 representatively illustrates a modified firing pin in accordance with an exemplary embodiment of the present technology.
Figure 18:
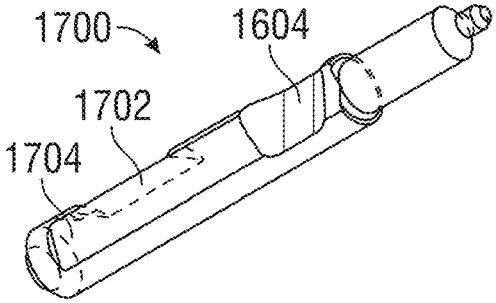
FIG. 18 representatively illustrates a perspective view of the modified firing pin in accordance with an exemplary embodiment of the present technology.
Figure 19:
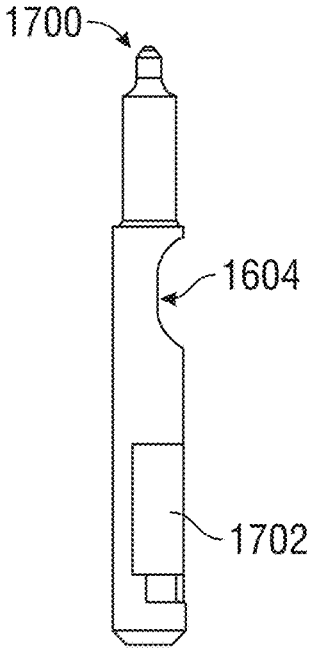
FIG. 19 representatively illustrates a left side view of the modified firing pin in accordance with an exemplary embodiment of the present technology.
Figure 20:
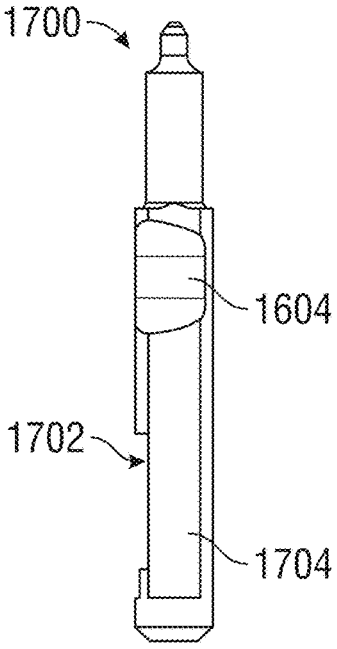
FIG. 20 representatively illustrates a top view of the modified firing pin in accordance with an exemplary embodiment of the present technology.
Figure 21:
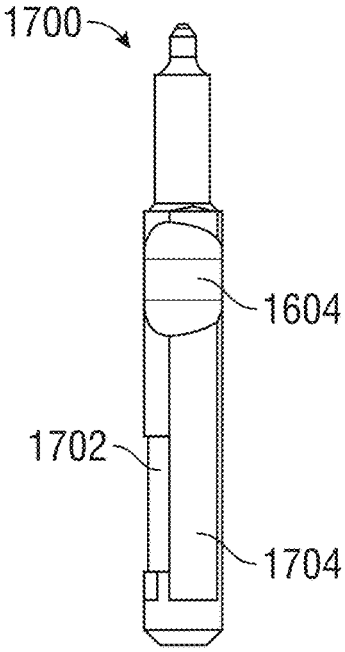
FIG. 21 representatively illustrates a right side view of the modified firing pin in accordance with an exemplary embodiment of the present technology.
Figure 22:
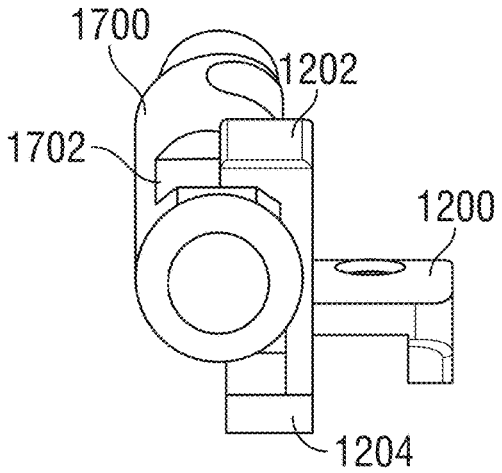
FIG. 22 representatively illustrates a rear view of the modified firing pin engaging the modified firing pin block in accordance with an exemplary embodiment of the present technology.
Figure 23:
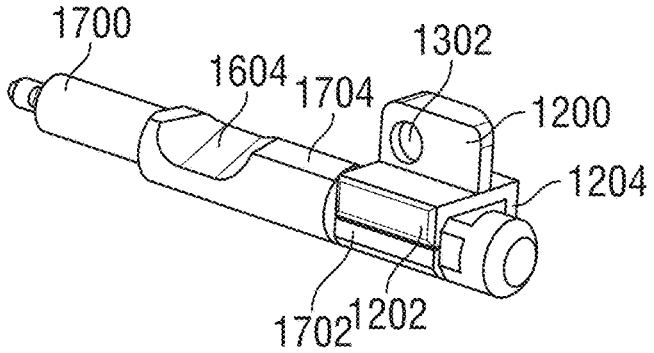
FIG. 23 representatively illustrates a rear top perspective view of the modified firing pin engaging the modified firing pin block in accordance with an exemplary embodiment of the present technology.
Figure 24:
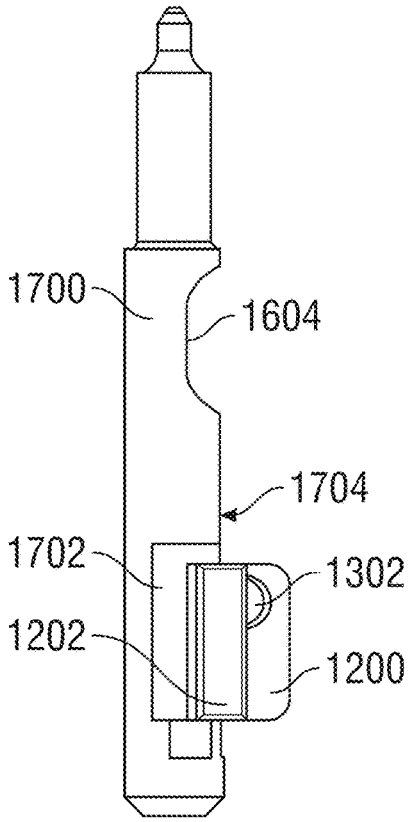
FIG. 24 representatively illustrates a top side view of the modified firing pin engaging the modified firing pin block in accordance with an exemplary embodiment of the present technology.
Figure 25:
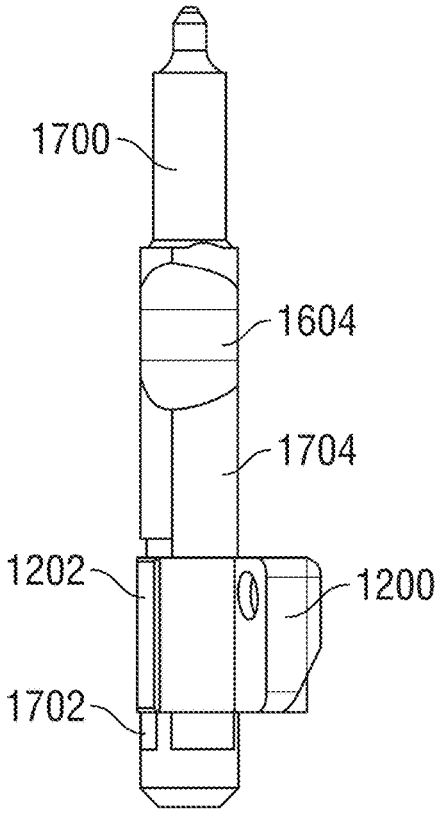
FIG. 25 representatively illustrates a right view of the modified firing pin engaging the modified firing pin block in accordance with an exemplary embodiment of the present technology.

To accommodate the modified firing pin block 1200, the firing pin may also need to be modified. For example, referring now to FIG. 16, a standard firing pin 1600 may comprise a first cut out 1602 that would engage the standard firing pin block 110 and a second cut out 1604 to allow the extractor (not shown) fit in position. Referring now to FIGS. 17-21, because the standard firing pin block 110 and associated retention pin cannot be used, a modified firing pin 1700 may be used in place of the standard firing pin 1600. The modified firing pin 1700 may include a first cut out section 1702 configured to receive and engage with the modified firing pin block 1200. The first cut out section 1702 may comprise a flattened section along a rear portion of the modified firing pin 1700 that is rotated approximately 90 degrees along a longitudinal axis of the modified firing pin 1700 relative to the first cut out 1602 of the standard firing pin 1600. The first cut out section 1702 of the modified firing pin 1700 may also have a shallower depth relative to the first cut out 1602 of the standard firing pin 1600 in that it does not extend as deep towards the longitudinal axis from the outermost surface of the firing pin 1700. This provides for more material in the location of the first cut out section 1702 increasing an overall strength of the firing pin 1700 and reducing a likelihood of failure over time.

The modified firing pin 1700 may further comprise a relief cut 1704 that may extend from a section proximate and end of the modified firing pin 1700 to the second cut out 1604. The relief cut 1704 may provide an improved fit when positioned within the modified slide mechanism 200.

Referring now to FIGS. 22-25, the relief cut 1704 may be configured to engage and abut a space extending between the first and second edge sections 1202, 1204 of the modified firing pin block 1200. During operation, when the trigger is pulled, the modified firing pin block 1200 may move upwardly such that a first edge section 1202 moves upward and away from the first cut out section 1702 allowing the modified firing pin 1700 to move forward slightly to strike the primer of the chambered cartridge. After striking the primer, the modified firing pin 1700 will return to its original position such that the first edge section 1202 of the modified firing pin block 1200 slides back into the first cut out section 1702 locking the modified firing pin 1700 in position until the trigger is pulled again.

These and other embodiments for methods of modifying a slide mechanism may incorporate concepts, embodiments, and configurations as described above. The particular implementations shown and described are illustrative of the technology and its best mode and are not intended to otherwise limit the scope of the present technology in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The technology has been described with reference to specific exemplary embodiments. Various modifications and changes, however, may be made without departing from the scope of the present technology. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of permutations to produce substantially the same result as the present technology and are accordingly not limited to the specific configuration recited in the specific examples. Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to an exemplary embodiment. However, changes and modifications may be made to the exemplary embodiment without departing from the scope of the present technology. These and other changes or modifications are intended to be included within the scope of the present technology, as expressed in the following claims.

The invention claimed is:

1. A slide for a firearm adapted to receive an optical sight, comprising:

a slide having a flat rear section recessed into a top portion of the slide, wherein the flat rear section:

comprises a first set of mounting holes; and is positioned below a topmost surface of the slide;

an adapter plate configured to be mounted within the recessed flat rear section by the at least one mounting hole, wherein the adapter plate comprises:

a second set of mounting holes aligned with the first set of mounting holes;

at least one mounting bus disposed along a top surface that is configured to align the optical sight with the adapter plate; and at least one receiving port disposed along a top surface that is configured to connect the optical sight to the adapter plate; and a firing pin block configured to be located beneath and not extend above a top surface of the flat rear section of the slide, wherein the firing pin block comprises:

a central body having a first end and a second end;

a first edge section extending perpendicularly from the first end of the central body;

a second edge section extending perpendicularly from the second end of the central body in a same direction as the first edge section; and a center catch extending perpendicularly outward from a center portion of the central body opposite in a direction opposite that of the first and second edge sections.

2. A slide for a firearm according to claim 1, further comprising a firing pin comprising:

a first flat section disposed along a rear portion of the firing pin; and a second flat section disposed along a rear portion of the firing pin and engaging the first flat section at a ninety-degree angle, wherein:

the first flat section is configured to engage one of the first and second edge sections; and the second flat section is configured to engage the center portion of the central body opposite the center catch.

3. A slide for a firearm according to claim 1, wherein the firing pin block further comprises a detent in the center catch.

4. A slide for a firearm according to claim 1, wherein the firing pin block further comprises a lip extending perpendicularly outward from an end of the center catch.

5. A slide for a firearm according to claim 1, further comprising a safety lever configured to:

be installed below the adapter plate; and a rotate without impacting the adapter plate.

6. A slide for a firearm according to claim 1, wherein the adapter plate further comprises a raised sighting element positioned along a rearmost edge of the adapter plate that extends upwardly away from the flat rear section of the slide.

7. A slide for a firearm according to claim 1, wherein:

a forward edge of the flat rear portion of the slide comprises a beveled portion; and the adapter plate comprises:

a forward edge of the adapted plate is configured to fit into the beveled portion; and a lip positioned above the forward edge and configured to abut a topmost surface of the slide above the recessed flat rear section.

8. A slide for a firearm adapted to receive an optical sight, comprising:

a slide having a flat rear section recessed into a top portion of the slide, wherein the flat rear section:

comprises:

a first set of mounting holes;

a first opening extending downwardly into the slide for holding a firing pin block, wherein the firing pin block is configured not to extend beyond the first opening and above a top surface of the flat rear section; and a second opening extending downwardly into the slide for holding an extractor pin, wherein the extractor pin is configured not to extend beyond the second opening and above the top surface of the flat rear section; and is positioned below a topmost surface of a forward portion of the slide; and an adapter plate configured to be mounted within the recessed flat rear section by the at least one mounting hole, wherein the adapter plate comprises:

a second set of mounting holes aligned with the first set of mounting holes;

at least one mounting bus disposed along a top surface that is configured to align the optical sight with the adapter plate; and at least one receiving port disposed along a top surface that is configured to connect the optical sight to the adapter plate.

9. A slide for a firearm according to claim 8, wherein the firing pin block comprises:

a central body having a first end and a second end;

a first edge section extending perpendicularly from the first end of the central body;

a second edge section extending perpendicularly from the second end of the central body in a same direction as the first edge section; and a center catch extending perpendicularly outward from a center portion of the central body opposite in a direction opposite that of the first and second edge sections.

10. A slide for a firearm according to claim 9, further comprising a firing pin comprising:

a first flat section disposed along a rear portion of the firing pin; and a second flat section disposed along a rear portion of the firing pin and engaging the first flat section at a ninety-degree angle, wherein:

the first flat section is configured to engage one of the first and second edge sections; and the second flat section is configured to engage the center portion of the central body opposite the center catch.

11. A slide for a firearm according to claim 9, wherein the firing pin block further comprises a detent in the center catch.

12. A slide for a firearm according to claim 9, wherein the firing pin block further comprises a lip extending perpendicularly outward from an end of the center catch.

13. A slide for a firearm according to claim 8, wherein the adapter plate further comprises a raised sighting element positioned along a rearmost edge of the adapter plate that extends upwardly away from the flat rear section of the slide.

14. A slide for a firearm according to claim 8, further comprising a safety lever configured to:

be installed below the adapter plate; and a rotate without impacting the adapter plate.

15. A slide for a firearm according to claim 8, wherein:

a forward edge of the flat rear portion of the slide comprises a beveled portion; and the adapter plate comprises:

a forward edge of the adapter plate is configured to fit into the beveled portion; and a lip positioned above the forward edge and configured to abut a topmost surface of the slide above the recessed flat rear section.

* * * * *